US009357816B2

(12) United States Patent
Matsushima

(10) Patent No.: US 9,357,816 B2
(45) Date of Patent: Jun. 7, 2016

(54) SLIDER FOR SLIDE FASTENER AND THE SLIDE FASTENER COMPRISING THE SAME

(75) Inventor: Hideyuki Matsushima, Shanghai (CN)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/356,234

(22) PCT Filed: Sep. 14, 2012

(86) PCT No.: PCT/CN2012/081375

§ 371 (c)(1), (2), (4) Date: May 5, 2014

(87) PCT Pub. No.: WO2013/067848

PCT Pub. Date: May 16, 2013

(65) Prior Publication Data

US 2014/0310923 A1 Oct. 23, 2014

(30) Foreign Application Priority Data

Nov. 7, 2011 (CN) ..... 2011 1 0346699

(51) Int. Cl.
*A44B 19/26* (2006.01)
*A44B 19/30* (2006.01)

(52) U.S. Cl.
CPC ..... *A44B 19/262* (2013.01); *A44B 19/30* (2013.01); *A44B 19/303* (2013.01); *A44B 19/305* (2013.01); *Y10T 24/2566* (2015.01); *Y10T 24/2568* (2015.01); *Y10T 24/2586* (2015.01)

(58) Field of Classification Search
CPC .... A44B 19/262; A44B 19/305; A44B 19/30; A44B 19/303; Y10T 24/2586; Y10T 24/2566; Y10T 24/2568
See application file for complete search history.

(56) References Cited

U.S. PATENT DOCUMENTS 3,112,546 A * 12/1963 Jensen ..... 24/419
3,335,586 A * 8/1967 Levine et al. ..... 70/68
3,368,249 A * 2/1968 Fukuroi ..... 24/420
3,820,203 A * 6/1974 Takamatsu ..... 24/419
5,632,070 A * 5/1997 Wakabayashi ..... 24/419

(Continued)

FOREIGN PATENT DOCUMENTS

CN 101380159 A 11/2009
CN 102014685 A 4/2011

(Continued)

OTHER PUBLICATIONS

International Search Report, PCT Application No. PCT/CN2012/081375, mailed Dec. 20, 2012.

*Primary Examiner* — Robert J Sandy
*Assistant Examiner* — Louis Mercado
(74) *Attorney, Agent, or Firm* — Kilpatrick Townsend & Stockton LLP

(57) ABSTRACT

There is provided a slider for slide fastener, including a slider body and a pull tab. A pair of supporting parts rotatably supporting the pull tab are provided on an upper surface of the slider body, and a claw for snapping elements of the slide fastener is provided on the pull tab. The pull tab is rotatable between a first posture in which the pull tab is placed down on the slider body and a second posture in which the pull tab is erected from the slider body. A stop member is provided on at least one of the slider body and the pull tab. The stop member limits the pull tab in an erect position of the second posture such that a front end of the claw is located within a protection space.

16 Claims, 16 Drawing Sheets

(56) References Cited

U.S. PATENT DOCUMENTS

| | | | | |
|---|---|---|---|---|
| 5,898,979 | A * | 5/1999 | Hamada | 24/418 |
| 7,665,194 | B2 | 2/2010 | Iwase | |
| 2009/0064468 | A1 | 3/2009 | Iwase | |
| 2011/0258818 | A1 | 10/2011 | Keyaki et al. | |

FOREIGN PATENT DOCUMENTS

| | | | |
|---|---|---|---|
| CN | 201839908 | U | 5/2011 |
| GB | 809030 | A | 2/1959 |

* cited by examiner

SLIDER FOR SLIDE FASTENER AND THE SLIDE FASTENER COMPRISING THE SAME

This application is a national stage application of PCT/CN2012/081375, which claims priority to Chinese Patent Application No. 201110346699.3, both of which are incorporated herein by reference.

TECHNICAL FIELD

The present invention relates to the technical field of a slide fastener, and particularly to a slider for slide fastener and a slide fastener comprising the slider.

BACKGROUND

For a slide fastener fixed to clothes or shoes, etc., when a wearer of the clothes or shoes is in movement, it is needed to prevent the pull tab of the slide fastener from swinging, the reason for which is: due to the swinging of the pull tab and knocking the body of the slider, it is possible to generate harsh sounds, in addition, scratches will be produced on the pull tab or the slider body and the coating will be peeled.

In order to solve the above problem, Patent Document 1 provides a slide fastener, the slider of which comprises a slider body and a pull tab rotatably supported on the slider body. The pull tab comprises a window part and left and right snapping flakes protruding from the edge of the window part. The slider body comprises a first column which can be snapped with or released from the left and right snapping flakes. The snapping flakes are snapped with the first column when the pull tab is in a first posture. When the snapping flakes rotate from the first posture to a second posture, the snapping flakes are released from the first column. Also, the pull tab has a claw which enters the elements path through the hole of the slider body when the pull tab is in the first posture. Moreover, the claw is released from the elements path when the pull tab is in the second posture.

Patent Document 1: CN102014685A.

SUMMARY OF INVENTION

Technical Problems to be Solved

However, in the invention of Patent Document 1 mentioned above, when the pull tab is in an erect posture or in a posture where it goes beyond the erect posture and inclines to the opposite side, the claw of the pull tab is released from the elements path and exposed from the upper surface of the slider body. Since the front end of the claw is sharper than other portions of the slider, when the wearer wants to grasp the pull tab to operate the slider, the claw is in contact with the fingers of the wearer, which may prick the figures.

The present invention has been developed for solving the problems mentioned above, with an aim to provide a slider for slide fastener and a slide fastener comprising the slider, and the slider for the slide fastener can prevent the claw formed on the pull tab of the slider from pricking the fingers, with the claw used for being engaged with the elements of the slide fastener to lock the slide fastener.

The present invention has another aim which is to provide a slider for slide fastener with a high strength, the pull tab of which will not be damaged even if being exerted with a force for bending the pull tab or a force for twisting the pull tab.

Means for Solving the Technical Problems

The present invention provides a slider for slide fastener, comprising a slider body and a pull tab, wherein a pair of supporting parts rotatably supporting the pull tab are provided on an upper surface of the slider body, and a claw for engaging elements of the slide fastener is provided on the pull tab, wherein the pull tab is rotatable between a first posture in which the pull tab is placed down on the slider body and a second posture in which the pull tab is erected from the slider body, characterized in that a stop member is provided on at least one of the slider body and the pull tab, the stop member limits the pull tab in an erect position of the second posture such that a front end of the claw is located within a protection space.

Preferably, the stop member is an abutting portion provided on one side of the pull tab, opposite to the side where the claw is formed, and when the pull tab is in the second posture, the abutting portion abuts the slider body.

Preferably, the stop member is a first column provided on the upper surface of the slider body and positioned at the front in a fore-and-aft direction of the slider body, and when the pull tab is in the second posture, the pull tab abuts the first column.

Preferably, the stop member is an abutting portion provided on one side of the pull tab, opposite to the side where the claw is formed and a first column provided on the upper surface of the slider body and positioned at the front in a fore-and-aft direction of the slider body, and when the pull tab is in the second posture, the abutting portion abuts the first column.

Preferably, the protection space is formed between the pair of the supporting parts.

Preferably, on the upper surface of the slider body, a second column is formed at a position opposite to the first column across the pair of the supporting parts, a hole communicating with an elements path is formed between the pair of the supporting parts in such a way that the hole passes through the upper surface of the slider body, a groove communicating with the hole is formed on the second column, the pull tab is provided with a window, the window is provided therein with a pair of left and right snapping flakes extending from an edge on one side to an edge on the other side, a head for being snapped with the pair of the snapping flakes is formed on the second column, and the protection space is formed at the groove.

Preferably, on the upper surface of the slider body, a second column is formed at a position opposite to the first column across the pair of the supporting parts, and between the pair of the supporting parts and the second column, the protection space is formed between a plane where a top surface of the second column is located and the upper surface of the slider body.

Preferably, the pull tab has a window which is provided therein with a rod and the rod protrudes from an edge of one side of the window and is connected with an edge of the opposite other side, and a first groove is formed at a top of the second column, and when the pull tab is in the first posture, at least one portion of the rod is accommodated in the first groove.

Preferably, the first groove extends along the fore-and-aft direction of the second column.

Preferably, between the pair of the supporting parts, a hole communicating with an elements path is formed in such a way that the hole passes through the upper surface of the slider body, and a pair of left and right protection members are formed on the upper surface of the slider body at a location closer to the supporting parts than the second column, with one member separated from the other member across the hole, and the protection space is formed between the pair of protection members.

Preferably, between the pair of the supporting parts, a hole communicating with an elements path is formed in such a way that the hole passes through the upper surface of the slider body, and a second groove communicating with the hole is formed on one side of the second column facing to the pair of the supporting parts, and the protection space is formed at the second groove.

Preferably, in the window, a pair of left and right snapping flakes extending from an edge of one side to an edge of the other side, are formed in a way of being separated by the rod, and a head snapped with the pair of snapping flakes is formed on the second column.

Preferably, the first groove is communicating with the second groove.

Preferably, opposite end edges arranged opposite to each other are formed respectively at front ends of the pair of snapping flakes, a protruding end edge protruding to left and right sides is formed on the head, and when the pull tab is in the first posture, the pair of snapping flakes are snapped with the head in such a way that the opposite end edges are located below the protruding end edges.

Preferably, the first column is provided with an inclining face which inclines downward from a top surface of the first column toward to the supporting parts.

Preferably, the pull tab is in bending shape such that when the pull tab is in the first posture, a front end of the pull tab is located lower than a portion thereof accommodated in the first groove.

Preferably, the window is formed by being surrounded by a base, a pair of left and right arms protruding from the left and right of the base, and a shaft connecting front ends of the left and right arms, the shaft is arranged between a front flake and a rear flake composing each of supporting parts, the arm has a first inner side face located on a side close to the shaft and a second inner side face located on a side away from the shaft, and when the pull tab is in the first posture, only the second inner side face is in contact with the rear flake; and when the pull tab is in the second posture, neither of the first and second inner side faces is in contact with the front flake.

Preferably, a front end of the pull tab is mounted with a cover member covering the front end, and the cover member is made of a soft material.

Preferably, the soft material is resin or rubber.

In addition, the present invention also provides a slide fastener which comprises the above slider for slide fastener.

Effects of Invention

With the above solution of the present invention, since when the pull tab is in the second posture, the front end of the claw is accommodated in the protection space, it is able to avoid the front end of the claw from contacting with fingers and pricking the fingers.

In addition, according to further solution of the present invention, since the window of the pull tab is provided therein with a rod, it can improve the strength of the pull tab, and even if being exerted with a force for bending the pull tab or a force for twisting the pull tab, the pull tab will not be damaged. Also, when the pull tab is in the second posture, the rod also functions as the portion contacting with the second column.

REFERENCE SIGNS LIST

Figure 1:
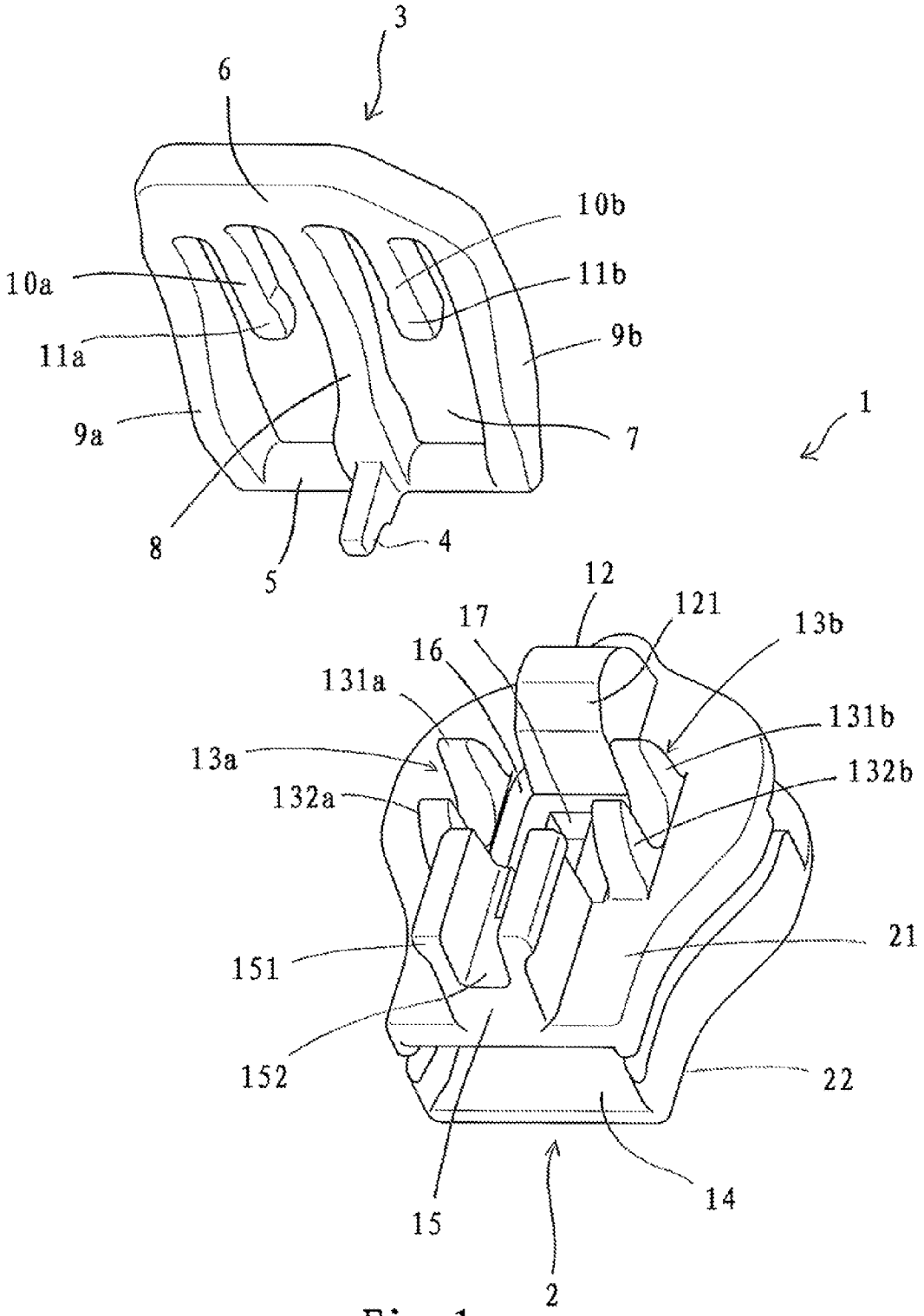
FIG. 1 is an exploded perspective view of the slider of the first embodiment of the present invention.

1 slider
2 slider body
3, 60, 70 pull tab
4 claw
5 shaft
6, 61,701 base
7 window
8 rod
9*a*, 9*b* arm
9*a*1, 9*b*1 first inner side face
9*a*2, 9*a*2 second inner side face
10*a*, 10*b* snapping flake
11*a*, 11*b* front end
111*a*, 111*b* opposite end edge
12, 31*a*, 31*b* first column
121, 311 inclining face
13*a*, 13*b*, 50*a*, 50*b* supporting part
131*a*, 131*b*, 51*b* front flake

132*a*, 132*b*, 52*b* rear flake
14 elements path
15, 30, 40, 115, 116 second column
151, 161 head
152, 401 first groove
153 second groove
154 protruding end edge
16 concave portion
17 hole
21 upper plate
22 lower plate
23 connecting column
41*a*, 41*b* protection member
71 cover member
702 through hole
80 abutting portion

DESCRIPTION OF EMBODIMENTS

Hereinafter, preferable embodiments of the present invention will be described referring to figures. In the following description, the protection space is the space intended to accommodate the front end of the claw formed on the pull tab of the slider so as to avoid the front end of the claw from contacting the fingers of the user. The claw is used for snapping with the elements of the slide fastener to lock the slide fastener.

First Embodiment

Figure 2:
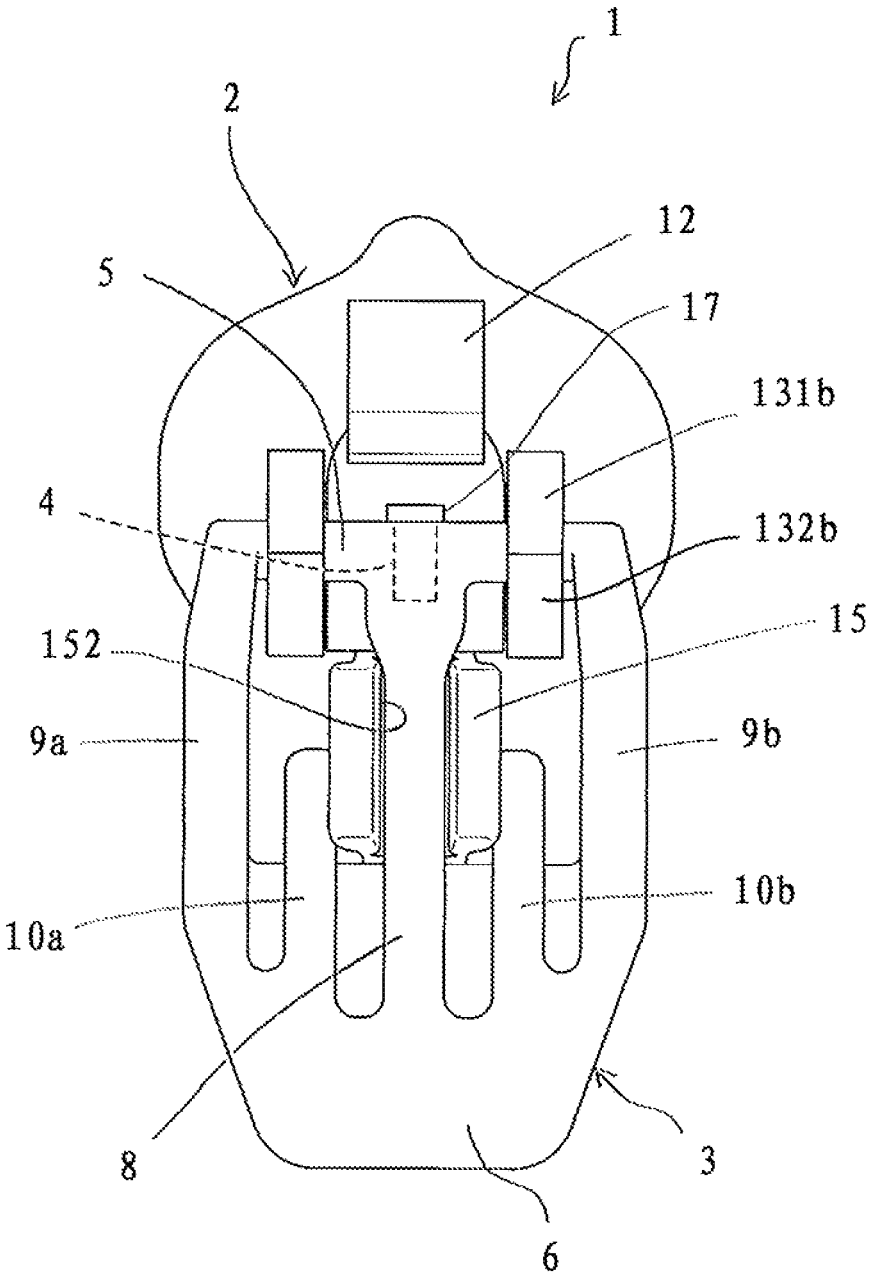
FIG. 2 is a top view of the slider of the first embodiment of the present invention with the pull tab in the first posture.
Figure 3:
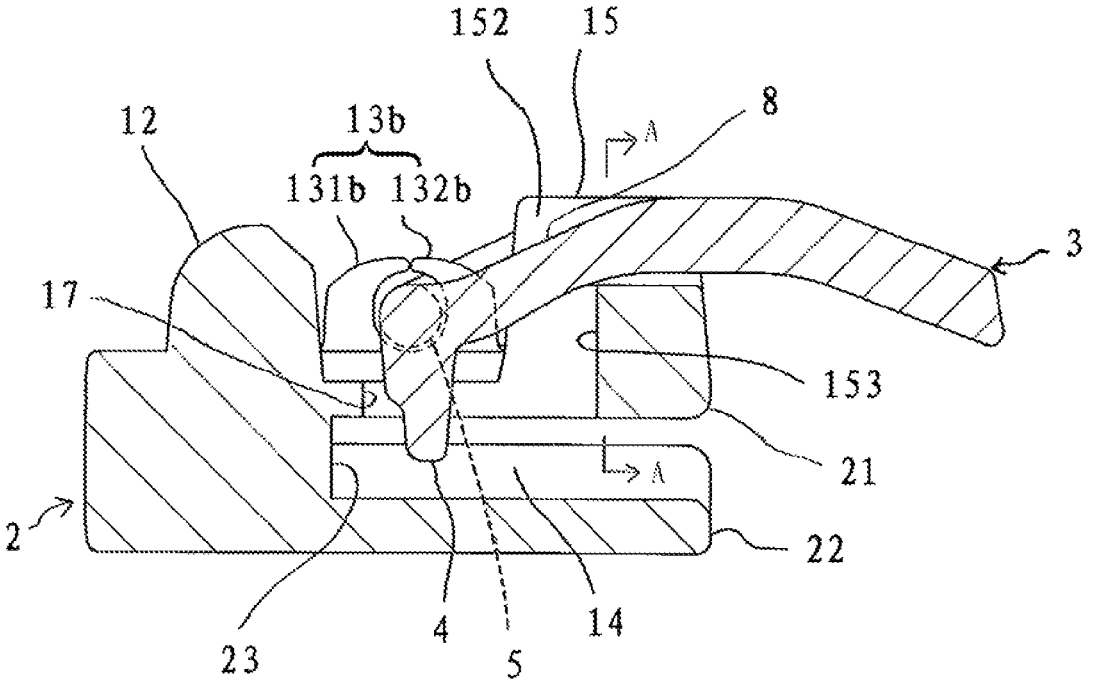
FIG. 3 is a sectional side view of the slider of the first embodiment of the present invention with the pull tab in the first posture.
Figure 4:
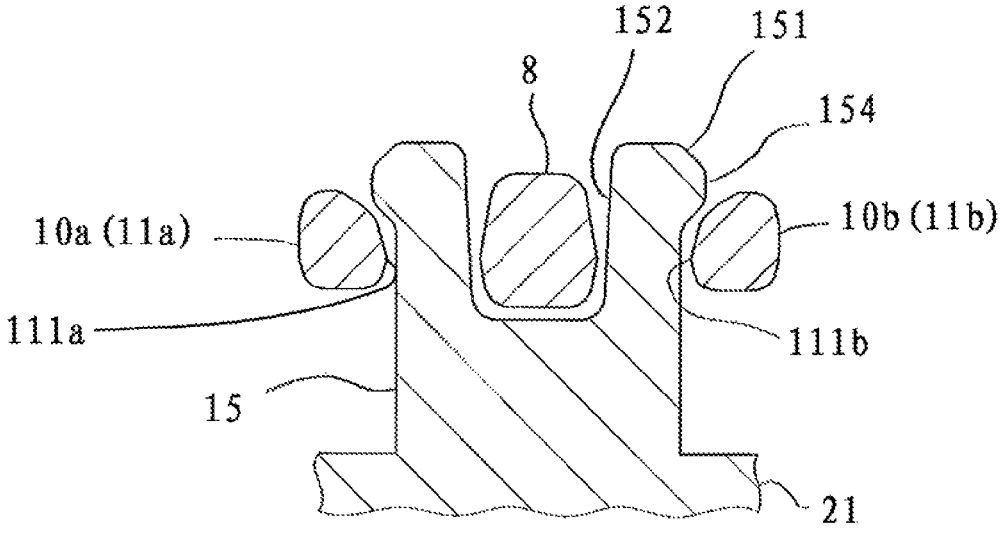
FIG. 4 is a sectional view along the line A-A of FIG. 3.
Figure 5:
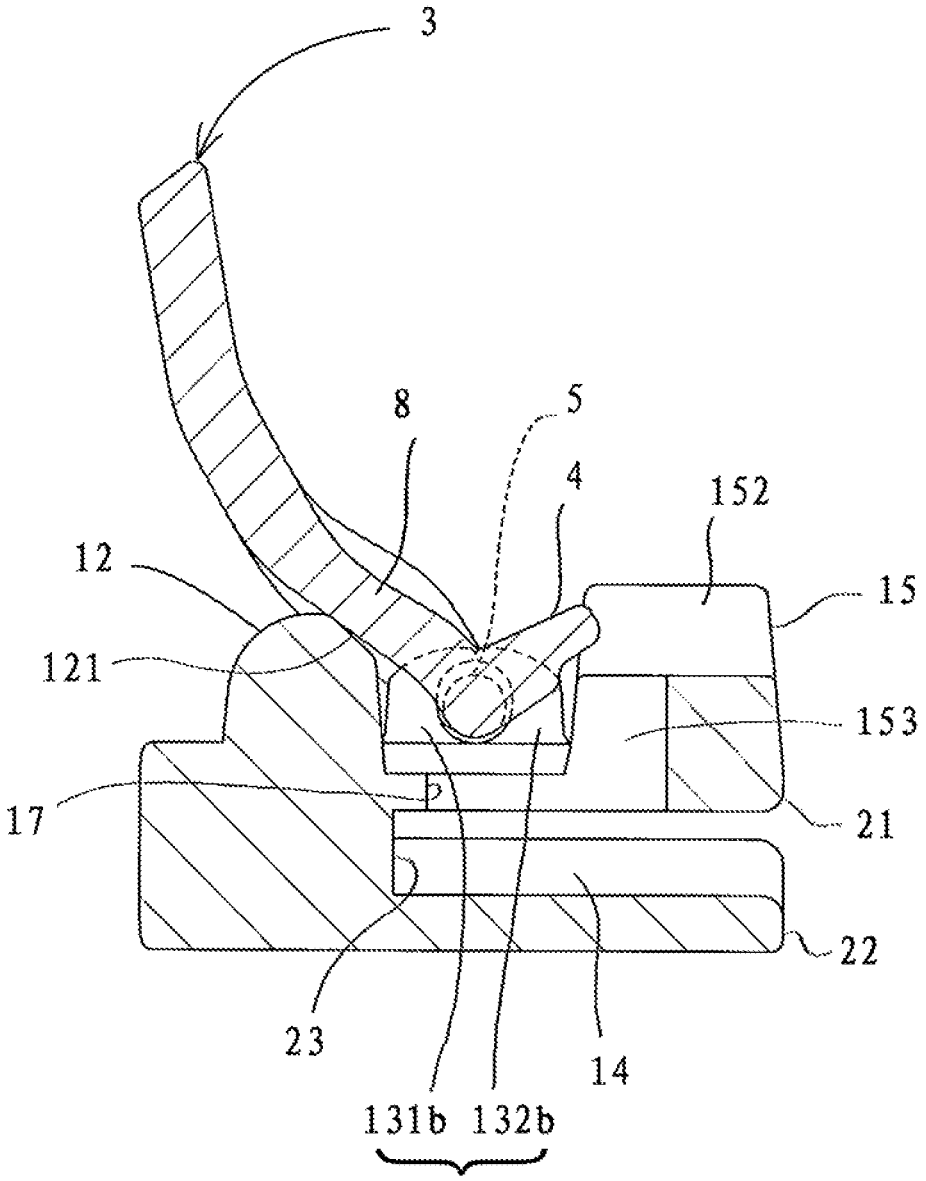
FIG. 5 is a sectional side view of the slider of the first embodiment of the present invention with the pull tab in the second posture.

FIGS. 1-5 are figures of the slider of the first embodiment of the present invention. FIG. 1 is an exploded perspective view of the slider of the first embodiment of the present invention. FIG. 2 is a top view of the slider of the first embodiment of the present invention with the pull tab in the first posture. FIG. 3 is a sectional side view of the slider of the first embodiment of the present invention with the pull tab in the first posture. FIG. 4 is a sectional view along the line A-A of FIG. 3. FIG. 5 is a sectional side view of the slider of the first embodiment of the present invention with the pull tab in the second posture.

As shown in FIG. 1, the slider 1 comprises a slider body 2 and a pull tab 3, and the pull tab 3 can rotate between a first posture where the pull tab is placed down on the slider body 3 and a second posture where the slider body 2 is erected. In the present embodiment, the front opening side of the slider body 2 (the wide opening side of the elements path) is the front of the slider body 2, and the rear opening side of the slider body 2 (the narrow opening side of the elements path) is the rear of the slider body 2. The left-right direction of FIG. 2 is the left-right direction of the slider body 2 and the pull tab 3, and the up-down direction of FIG. 3 is the up-down direction of the slider body 2 and the pull tab 3.

The slider body 2 comprises the upper plate 21 and the lower plate 22 arranged in parallel with one being above the other. The upper plate 21 and the lower plate 22 are connected by the connecting column 23 at the front end of the slider body 2. Between the upper plate 21 and the lower plate 22 is provided the elements path 14 through which the elements of the chain can pass. On the upper surface of the slider body 2, a pair of left and right supporting parts 13*a* and 13*b* rotatably supporting the pull tab 3, are provided at the central position along the fore-and-aft direction of the slider body 2. Each supporting part comprises a front flake and a rear flake which are arranged at interval along the fore-and-aft direction of the slider body 2. The front flakes 131*a*, 131*b* and the rear flakes 132*a*, 132*b* of the supporting parts 13*a*, 13*b* protrude upward from the upper surface of the upper plate 21 of the slider body 2. The shaft 5 of the pull tab 3 which will be discussed later is arranged between the front flakes 131*a*, 131*b* and the rear flakes 132*a*, 132*b*. Between the left supporting part 13*a* and the right supporting part 13*b*, there is provided a concave portion 16 which is formed by making the upper surface of the upper plate 21 of the slider body 2 concave. A hole 17 communicating with the elements path 14 is formed at the bottom of the concave portion 16 so as to pass through the upper plate 21 in the up-down direction.

On the slider body 2, a first column 12, as the stop member, is provided at the front in the fore-and-aft direction of the slider body 2, with the first column 12 protruding upward from the upper surface of the upper plate 21. The first column 12 is provided with an inclining face 121 which inclines downward from the top face thereof toward the left and right supporting parts 13*a*, 13*b*.

On the slider body 2, a second column 15 is provided at the rear portion along the fore-and-aft direction of the slider body 2 so as to be opposite to the first column 12 across the left supporting part 13*a* and the right supporting part 13*b*, with the second column protruding upward from the upper surface of the upper plate 21. The top of the second column 15 has the head 151 protruding toward the left and right side (i.e., the left and right directions of the slider body) of the second column 15. A first groove 152 extending along the fore-and-aft direction of the second column 15 is formed at the center of the top of the second column 15 in the left-right direction.

The pull tab 3 comprises a plate-like base 6, and a pair of arms (left and right) 9*a*, 9*b* protruding and extending from the left and right sides of the base 6. The front ends of the left and right arms 9*a*, 9*b* are connected through the shaft 5. A claw 4 protruding toward below the pull tab 3 is provided at the center of the shaft 5 in the left-right direction. The claw 4 is engaged with the elements of the slide fastener in the elements path 14. The base 6, the left and right arm 9*a*, 9*b* and the shaft 5 surround a portion which is the window 7. The window 7 is provided therein with a rod 8 which protrudes from the edge of the base side of the window 7 and connected with the opposite edge of the shaft side, and a pair of snapping flakes 10*a*, 10*b* (left and right) extending from the edge of the base side to the edge of the shaft side in means of sandwiching the rod 8. The front end of one of the left and right snapping flakes 10*a*, 10*b* protrudes toward the other one which is opposite to it.

As shown in FIG. 2, the pull tab 3 is mounted on the slider body 2 in the way that the shaft 5 of the pull tab 3 is arranged between the front flakes 131*a*, 131*b* and the rear flakes 132*a*, 132*b* of the left and right supporting parts 13*a* and 13*b*, and then the front end of the front flake and the front end of the rear flake are deformed along such direction that they are approaching to each other. Thus, the left supporting part 13*a*, at the position between the left arm 9*a* of the pull tab 3 and the rod 8, supports the shaft 5 of the pull tab 3, and the right supporting part 13*b*, at the position between the right arm 9*b* of the pull tab 3 and the rod 8, supports the shaft 5 of the pull tab 3. When the pull tab 3 is in the first posture (i.e., the posture of being placed down the slider body 2), one portion of the rod 8 is accommodated in the first groove 152 of the second column 15, and the left and right snapping flakes 10*a*, 10*b* are arranged on the left and right sides of the second column 15. That is, when the pull tab 3 is in the first posture, it can avoid the rod 8 from interfering with the second column 15.

As shown in FIG. 3, when the pull tab 3 is in the first posture, the claw 4 enters the elements path 14 through the hole 17. Also, the side of the second column 15 facing to the left supporting part 13*a* and the right supporting part 13*b* is also provided with a second groove 153 communicating with the hole 17, and the second groove 153 extends along the up-down direction of the second column 15 and is communicating with the first groove 152.

As shown in FIG. 4, when the pull tab 3 is in the first posture, the left and right snapping flakes 10*a*, 10*b* are snapped with the head 151 in such a way that the opposite end edges 111*a*, 111*b* of the front ends 11*a*, 11*b* of the left and right snapping flakes 10*a*, 10*b*, which are arrange opposite to each other, are located below the protruding end edge 154 which is formed on the head 151 and protruding to the left and right sides. Thus, when the snapping flakes 10*a*, 10*b* are snapped with the head 151 of the second column 15, the pull tab 3 is kept in the first posture. When the pull tab 3 rotates from the first posture to the second posture, the opposite end edges 111*a*, 111*b* of the front ends 11*a*, 11*b* of the left and right snapping flakes 10*a*, 10*b* moves upwards, to be in contact with the protruding end edge 154 of the head 151 of the second column 15. Afterwards, the left and right snapping flakes 10*a*, 10*b* are elastically deformed in such a way that the spacing between the front ends 11*a*, 11*b* thereof is increased. Then, when the opposite end edges 111*a*, 111*b* of the front ends 11*a*, 11*b* of the left and right snapping flakes 10*a*, 10*b* move over the protruding end edge 154 of the head 151 of the second column 15, the left and right snapping flakes 10*a*, 10*b* are elastically restored, and the increased spacing between the front ends 11*a* and 11*b* are restored to the original spacing.

As shown in FIG. 5, when the pull tab 3 is in the second posture (that is, the posture of the slider body 2 being erected), the pull tab 3 abuts the first column 12, and particularly the rod 8 of the pull tab 3 abuts the inclining face 121 of the first column 12 such that the first column 12 can be used to limit the pull tab 3 as being in the erect position of the second posture, preventing the pull tab 3 from further inclining toward the opposite direction (the front direction). When shaping the slider body 2, by means of presetting the angle of the inclining face 121 of the first column as an appropriate angle, the pull tab 3 can be set as being in the erect position of the second posture. Herein, the claw 4 is released from the elements path 14 and the hole 17, to move into the second groove 153 (in FIG. 5, it moves into the portion of the second groove 153 communicating with the first groove 152). That is, when the pull tab 3 rotates from the first posture to the second posture, the second groove 153 becomes the moving path for the claw 5, which therefore will not obstruct the moving of the claw 4. In such situation, the front end of the claw 4 is received in the second groove 153, not protruding from the top face of the second column 15, and the second groove 153 functions as the protection space.

In addition, in the first embodiment, although illustrating as an example that the concave portion is formed on the upper surface of the slider body and the hole is formed in the bottom of the concave portion, it is possible that no concave portion is formed, but a hole communicating with the elements path is directly formed in the way of passing through the upper surface of the slider body.

Second Embodiment

Figure 6:
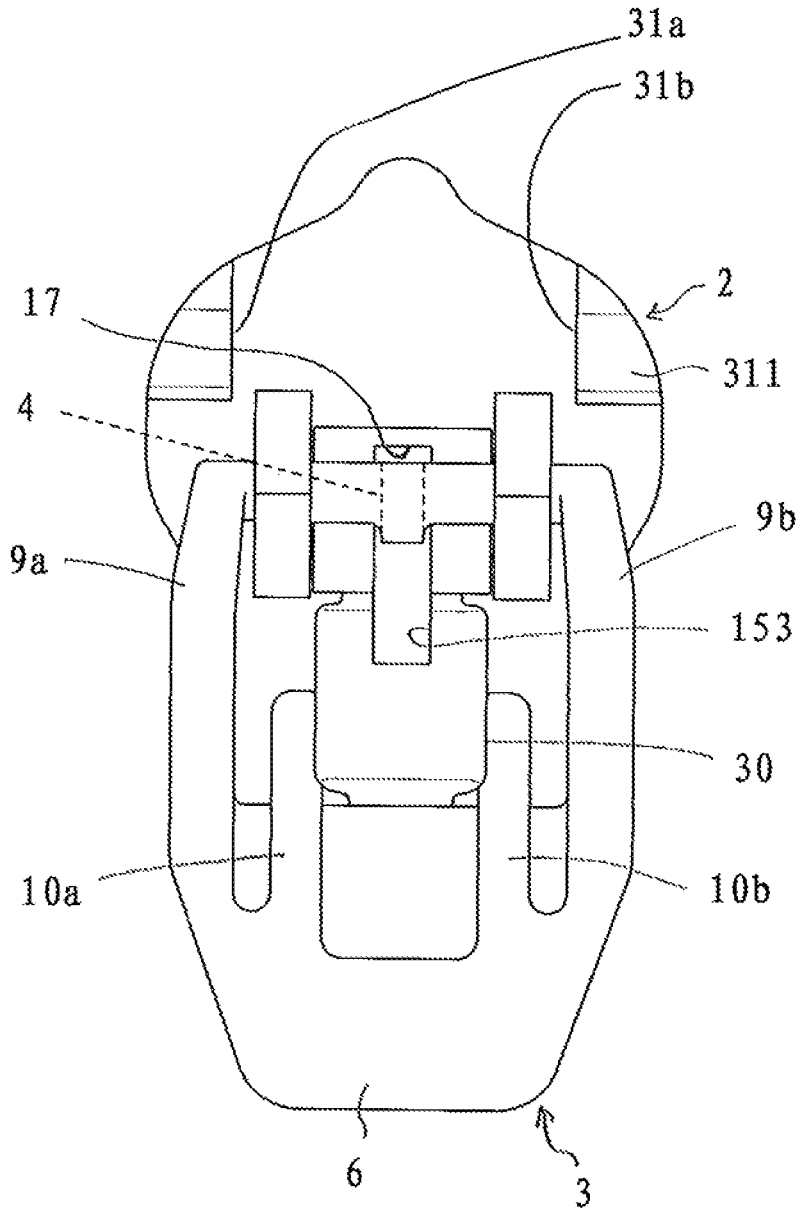
FIG. 6 is a top view of the slider of the second embodiment of the present invention with the pull tab in the first posture.
Figure 7:
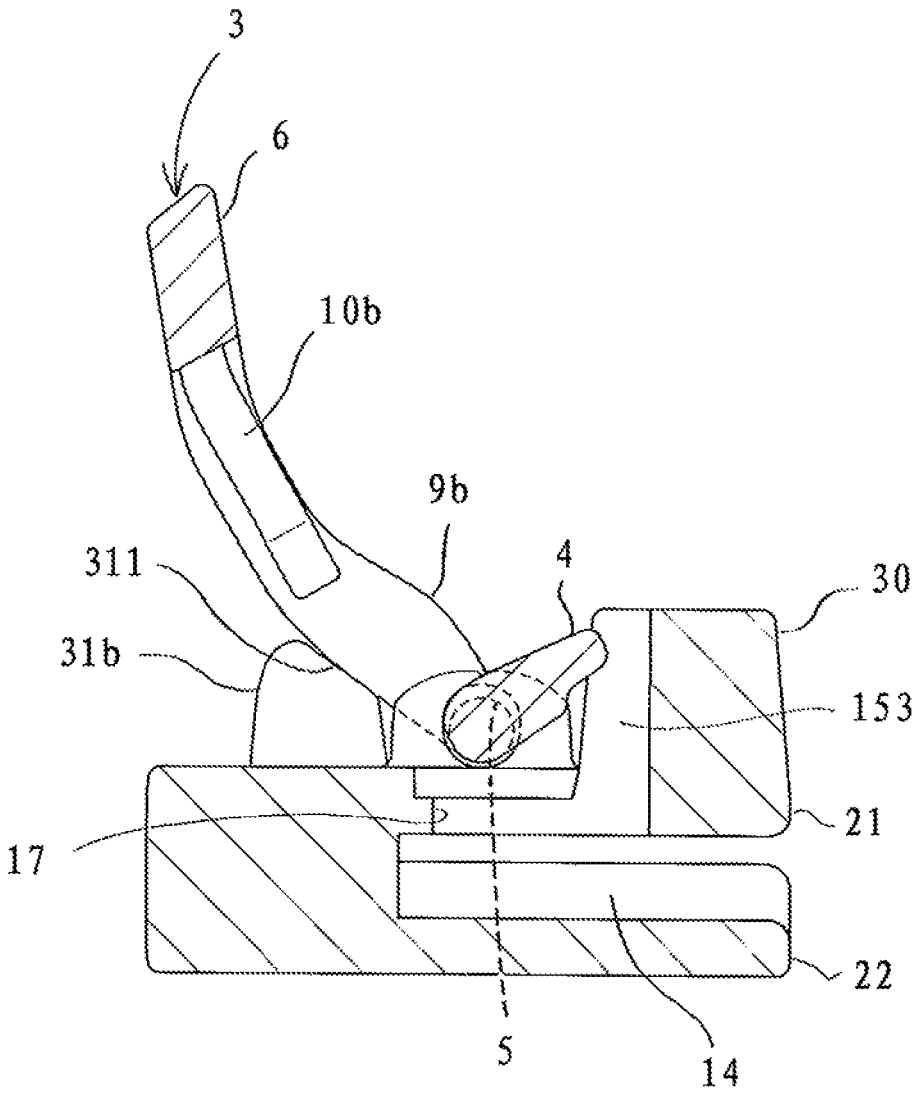
FIG. 7 is a sectional side view of the slider of the second embodiment of the present invention with the pull tab in the second posture.

FIGS. 6 and 7 are views of the slider of the second embodiment of the present invention. FIG. 6 is a top view of the slider of the second embodiment of the present invention with the pull tab in the first posture. FIG. 7 is a sectional side view of the slider of the second embodiment of the present invention with the pull tab in the second posture. In addition, in the description of the present embodiment, the same or corresponding part to the first embodiment is assigned with a same reference sign, and the description thereof is omitted.

As shown in FIGS. 6 and 7, compared to the first embodiment, in the present second embodiment, the rod and the first groove for accommodating the rod are not provided. Also, as an alternative for one first column provided in the first embodiment, a pair (left and right) of first columns 31*a*, 31*b*, in the present second embodiment, are provided at the front side of the slider body 2, along the opposite left and right side edges of the slider body 2, with the pair (left and right) of first columns 31*a*, 31*b* protruding upward from the upper surface of the upper plate 21 of the slider body 2. Each of the first columns is formed with an inclining face 311 inclining downward from the top face thereof to the pair (left and right) of the supporting parts 13*a*, 13*b*.

As shown in FIG. 7, when the pull tab 3 is in the second posture, the pull tab 3 abuts the first columns 31*a*, 31*b*, and particularly, the left and right arms 9*a*, 9*b* of the pull tab 3 abut respectively the inclining faces 311 of the left and right first columns 31*a*, 31*b*, so as to use the left and right first columns 31*a*, 31*b* to limit the pull tab 3 in the erect position of the second posture, preventing the pull tab 3 from further inclining to the opposite direction (the front direction).

Herein, the claw 4 is released from the elements path 14 and the hole 17, to move into the second groove 153. That is, when the pull tab 3 rotates from the first posture to the second posture, the second groove 153 becomes the moving path of the claw 4, thus it will not obstruct the moving of the claw 4. In such situation, the front end of the claw 4 is received in the second groove 153, not protruding from the top face of the second column 30, and the second groove 153 functions as the protection space.

Third Embodiment

Figure 8:
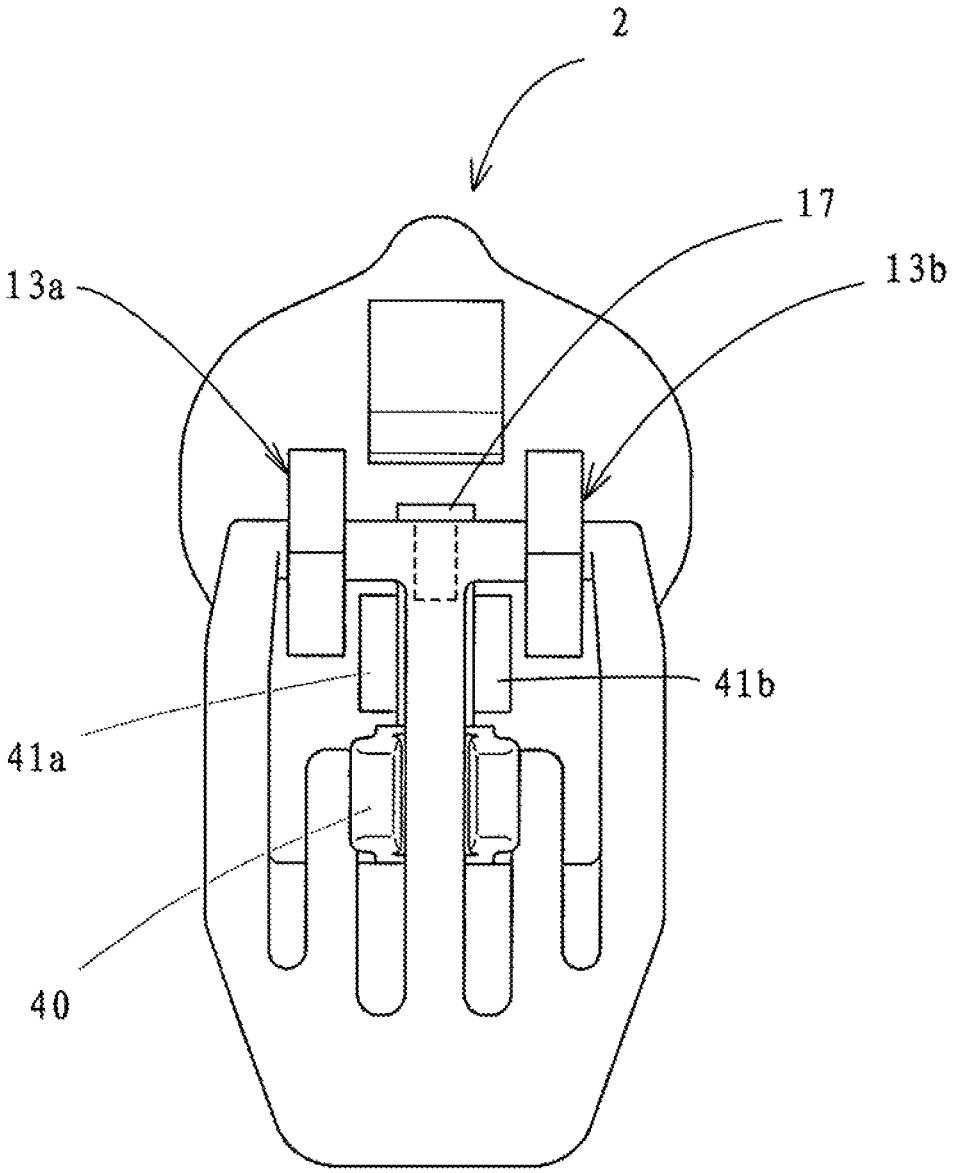
FIG. 8 is a top view of the slider of the third embodiment of the present invention with the pull tab in the first posture.
Figure 9:
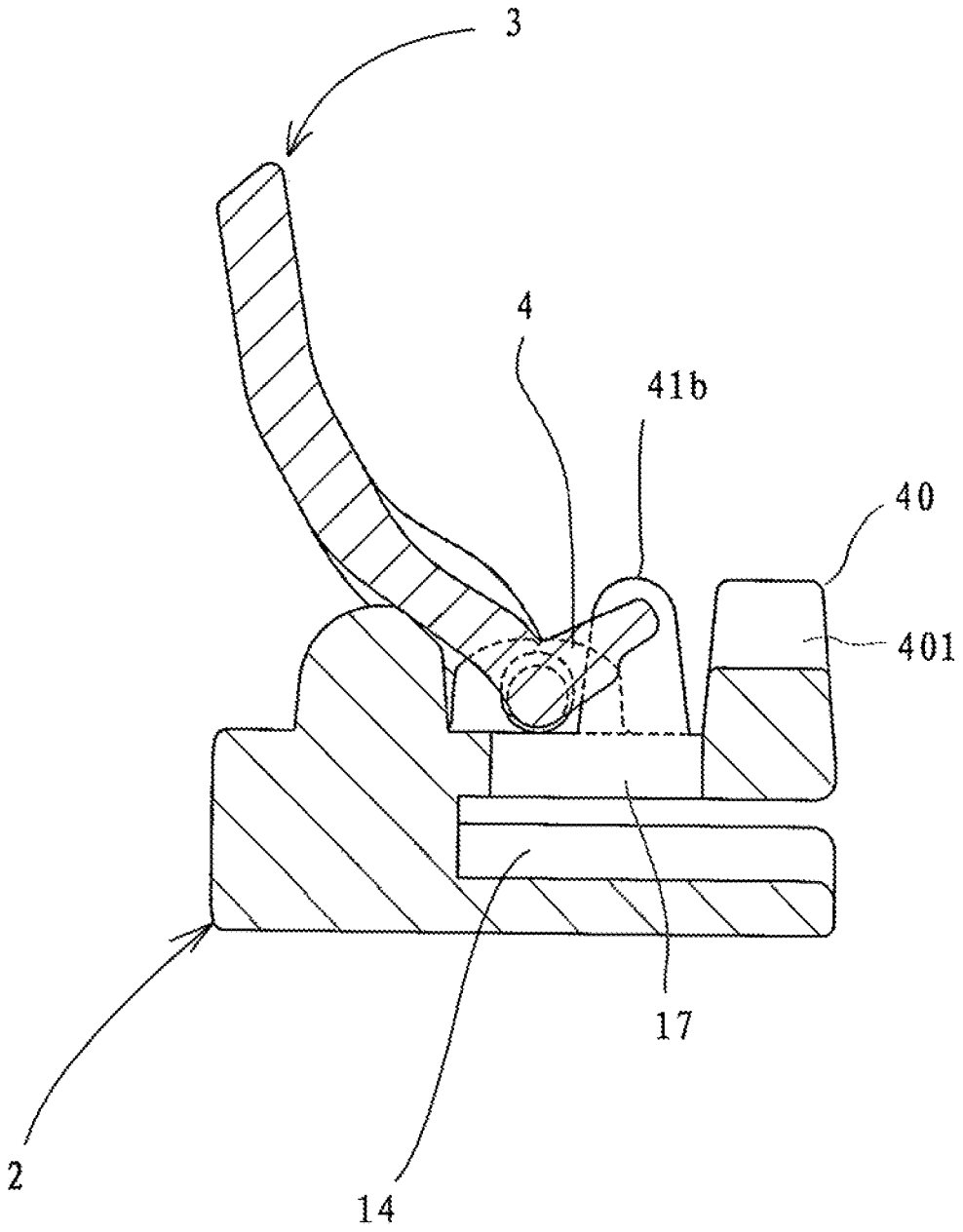
FIG. 9 is a sectional side view of the slider of the third embodiment of the present invention with the pull tab in the second posture.

FIGS. 8 and 9 are views of the slider of the third embodiment of the present invention. FIG. 8 is a top view of the slider of the third embodiment of the present invention with the pull tab in the first posture. FIG. 9 is a sectional side view of the slider of the third embodiment of the present invention with the pull tab in the second posture. In addition, in the description of the present embodiment, the same or corresponding part to the first embodiment is assigned with a same reference sign, and the description thereof is omitted.

As shown in FIGS. 8 and 9, compared to the first embodiment, in the present third embodiment, no concave portion is formed, but between the pair (left and right) of the supporting parts 13*a*, 13*b*, a hole 17 communicating with the elements path 14 is directly formed in the fore-and-aft direction of the slider body 2 in such a way that it passes in the up-down direction through the upper surface 21 of the slider body 2. Additionally, in the present third embodiment, no second groove is formed on the second column 40, but on the upper surface of the slider body 2, a pair (left and right) of protection members 41*a*, 41*b* are formed at the position closer to the supporting parts 13*a*, 13*b* than the second column 40, in the way that they are separated by the hole 17. The left and right protection members 41*a*, 41*b* protrude upward from the upper surface of the upper plate 21 of the slider body 2.

As shown in FIG. 9, when the pull tab 3 is in the second posture, the claw 4 is released from the elements path 14 and the hole 17, and move to between the pair (left and right) of the protection members 41*a*, 41*b*. Herein, the front end of the claw 4 is received between the pair (left and right) of the protection members 41*a*, 41*b*, not protruding from the edges of the pair (left and right) of the protection members 41*a*, 41*b*, and the space between the pair (left and right) of the protection members 41*a*, 41*b* functions as the protection space.

Forth Embodiment

Figure 10:
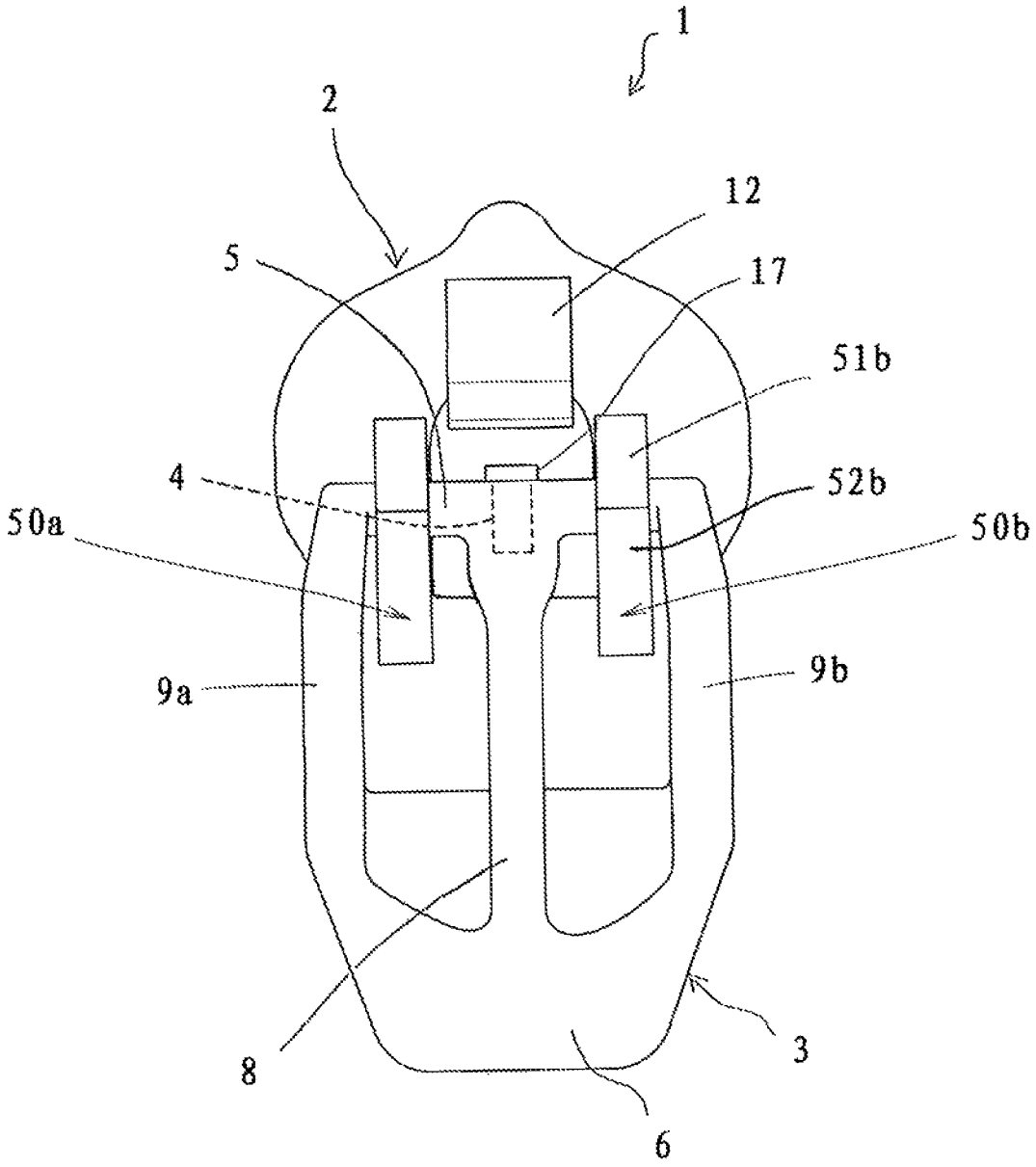
FIG. 10 is a top view of the slider of the fourth embodiment of the present invention with the pull tab in the first posture.
Figure 11:
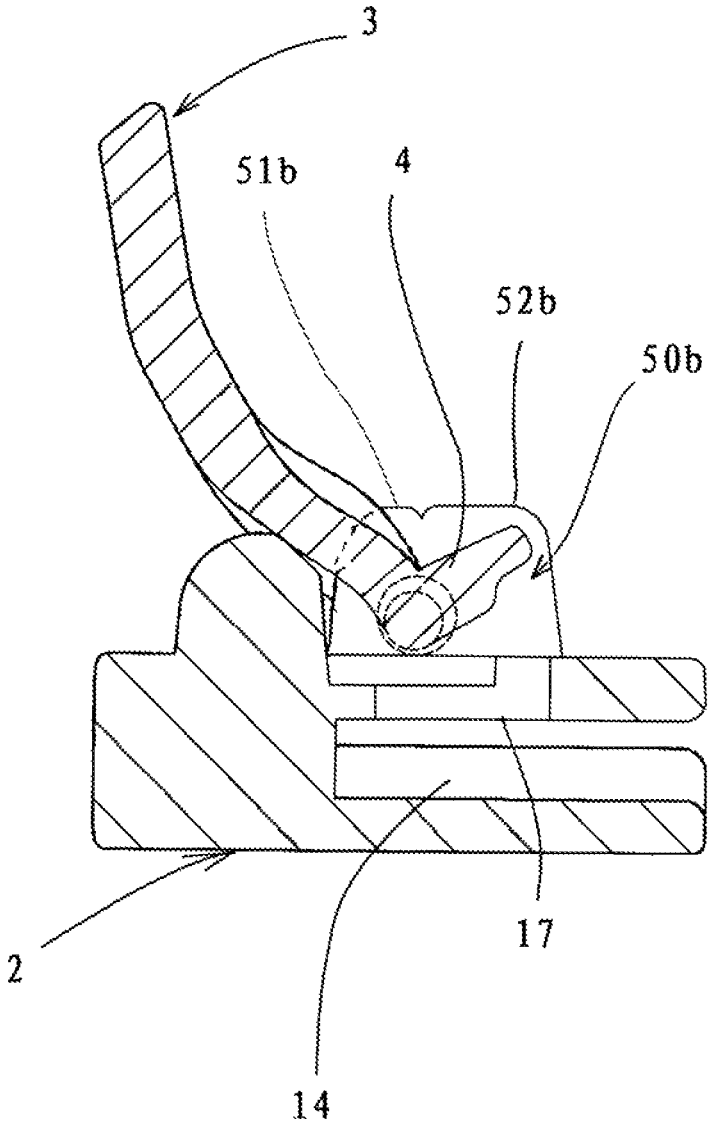
FIG. 11 is a sectional side view of the slider of the fourth embodiment of the present invention with the pull tab in the second posture.

FIGS. 10 and 11 are views of the slider of the fourth embodiment of the present invention. FIG. 10 is a top view of the slider of the fourth embodiment of the present invention with the pull tab in the first posture. FIG. 11 is a sectional side view of the slider of the fourth embodiment of the present invention with the pull tab in the second posture. In addition, in the description of the present embodiment, the same or corresponding part to the first embodiment is assigned with a same reference sign, and the description thereof is omitted.

As shown in FIGS. 10 and 11, compared to the first embodiment, in the present fourth embodiment, the pair (left and right) supporting parts 50*a*, 50*b* has the rear flake formed longer and higher. After the front end of the front flake and the front end of the rear flake are deformed in the direction of approaching to each other, the pair of the supporting parts 50*a*, 50*b* are formed to present the size capable of accommodating the claw 4 of the pull tab 3 in the second posture. Moreover, in the present fourth embodiment, no second column is formed on the slider body 2, and no left and right snapping flakes are formed on the pull tab 3.

As shown in FIG. 11, when the pull tab 3 is in the second posture, the claw 4 is released from the elements path 14 and the hole 7, to move to between the pair (left and right) supporting parts 50*a*, 50*b*. Herein, the front end of the claw 4 is accommodated between the pair (left and right) supporting parts 50*a*, 50*b*, not protruding from the edges of the pair (left and right) supporting parts 50*a*, 50*b*. The space between the pair (left and right) supporting parts 50*a*, 50*b* functions as the protection space.

Fifth Embodiment

Figure 12:
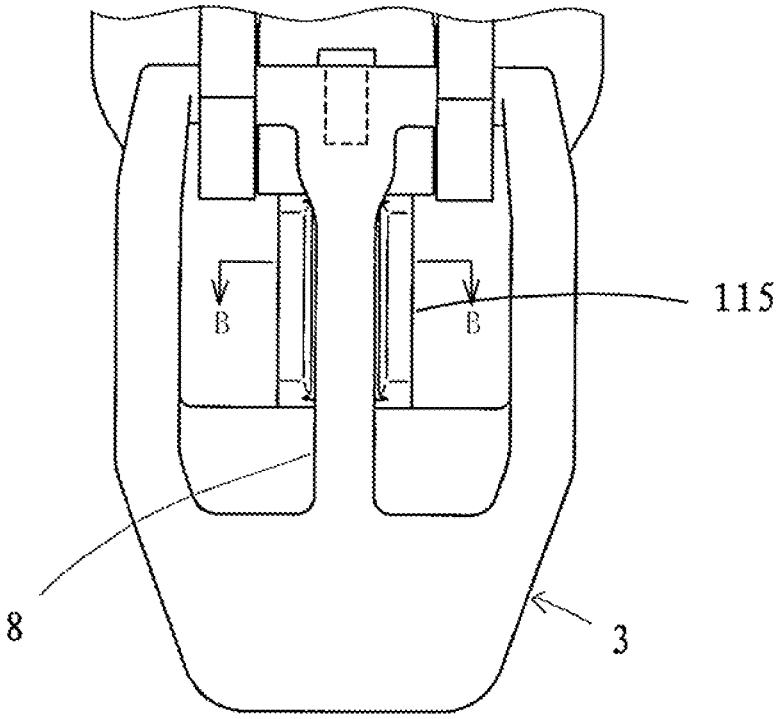
FIG. 12 is a partial top view of the slider of the fifth embodiment of the present invention, with the pull tab in the first posture.
Figure 13:
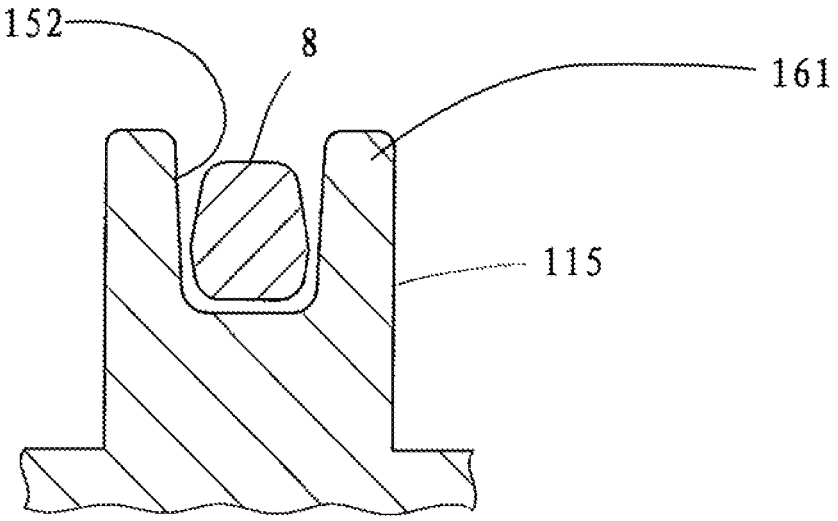
FIG. 13 is a sectional view along the line B-B in FIG. 12.

FIGS. 12 and 13 are views of the slider of the fifth embodiment of the present invention. FIG. 12 is a partial top view of the slider of the fifth embodiment of the present invention, with the pull tab in the first posture. FIG. 13 is a sectional view along the line B-B in FIG. 12. In addition, in the description of the present embodiment, the same or corresponding part to the first embodiment is assigned with a same reference sign, and the description thereof is omitted.

As shown in FIGS. 12 and 13, compared to the first embodiment, in the present fifth embodiment, the pull tab 3 is not provided with left and right snapping flakes thereon, and the head 161 of the second column 115 does not protrude to the left and right directions of the second column 115, that is, the head 161 is not provided with a protruding end edge. Thus, when the pull tab 3 is in the first posture, the pull tab 3 is not snapped with the second column 115, and only one portion of the rod 8 is accommodated in the first groove 152 of the second column 115.

Sixth Embodiment

Figure 14:
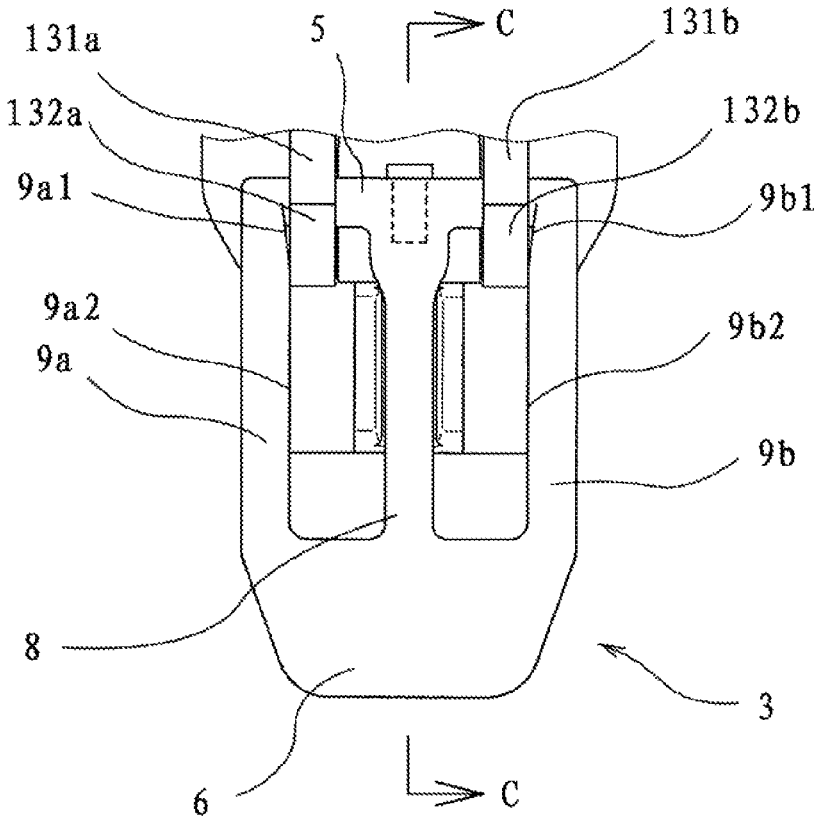
FIG. 14 is a partial top view of the slider of the sixth embodiment of the present invention, with the pull tab in the first posture.
Figure 15:
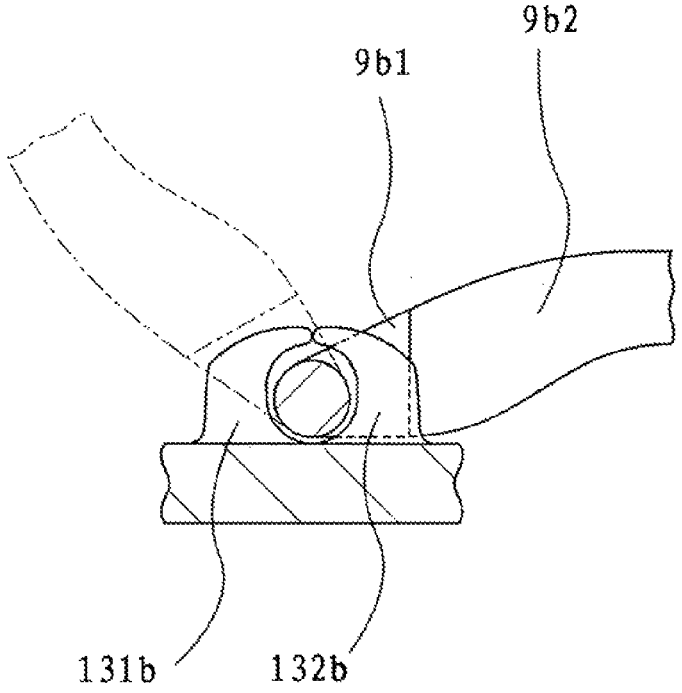
FIG. 15 is sectional view along the line C-C in FIG. 14.

FIGS. 14 and 15 are views of the slider of the sixth embodiment of the present invention. FIG. 14 is a partial top view of the slider of the sixth embodiment of the present invention, with the pull tab in the first posture. FIG. 15 is sectional view along the line C-C in FIG. 14. The present embodiment is the alternative embodiment of the fifth embodiment. In the description of the present embodiment, the same or corresponding part to the fifth embodiment is assigned with a same reference sign, and the description thereof is omitted.

As shown in FIGS. 14 and 15, compared to the fifth embodiment, in the present sixth embodiment, the arms 9*a*, 9*b* respectively have a first inner side face 9*a*1, 9*b*1 located on the side close to the shaft 5 and a second inner side face 9*a*2, 9*b*2 located on the side away from the shaft. Considering the first inner side face 9*a*1 and the first inner side face 9*b*1 as well as the second inner side face 9*a*2 and the second inner side face 9*b*2 each have identical structures, in the following description, the description is only made with the example of the first inner side face 9*b*1 and the second inner side face 9*b*2 at the right of FIG. 14.

When the pull tab 3 is in the first posture, the first inner side face 9*b*1 is opposite to the rear flake 132*b* of the supporting part 13*b* in the way of having a gap therebetween. When the pull tab 3 is in the second posture, the first inner side face 9*b*1 is opposite to the front flake 131*b* of the supporting part 13*b* in the way of having a gap therebetween. Therefore, no matter what posture it takes, the first inner side face 9*b*1 is not in contact with the rear flake 132*b* and the front flake 131*b*, not obstructing the pull tab 3 from rotating from the first posture to the second posture.

Correspondingly, when the pull tab 3 is in the first posture, the second inner side face 9*b*2 is opposite to the rear flake 132*b* of the supporting part 13*b* in the way of having no gap therebetween. That is, the second inner side face 9*b*2 is in contact with the rear flake 132*b*. When the pull tab 3 is in the second posture, the second inner side face 9*b*2 is not opposite to the front flake 131*b* of the supporting part 13*b*. That is, the second inner side face 9*b*2 is not in contact with the front flake 131*b*. Therefore, the second inner side face 9*b*2 is in contact with the rear flake 132*b* of the supporting part 13*b* only when the pull tab 3 is in the first posture. Thus, when the pull tab 3 is in the first posture, the second inner side face 9*b*2 and the rear flake 132*b* of the supporting part 13*b* press each other, and the posture of the pull tab is maintained in place by means of friction forces.

In the above, although the description is made with the example of the first inner side face 9*b*1 and the second inner side face 9*b*2 at the right of FIG. 14, the first inner side face 9*a*1 and the second inner side face 9*a*2 at the left of FIG. 14 have the same structures and functions.

Seventh Embodiment

Figure 16:
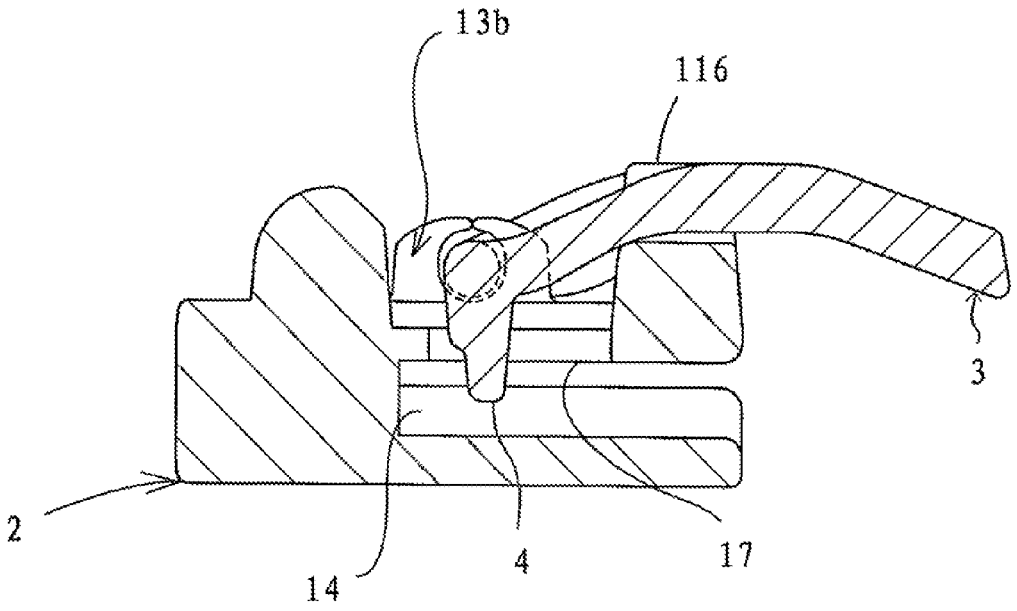
FIG. 16 is a sectional side view of the slider of the seventh embodiment of the present invention with the pull tab in the first posture.
Figure 17:
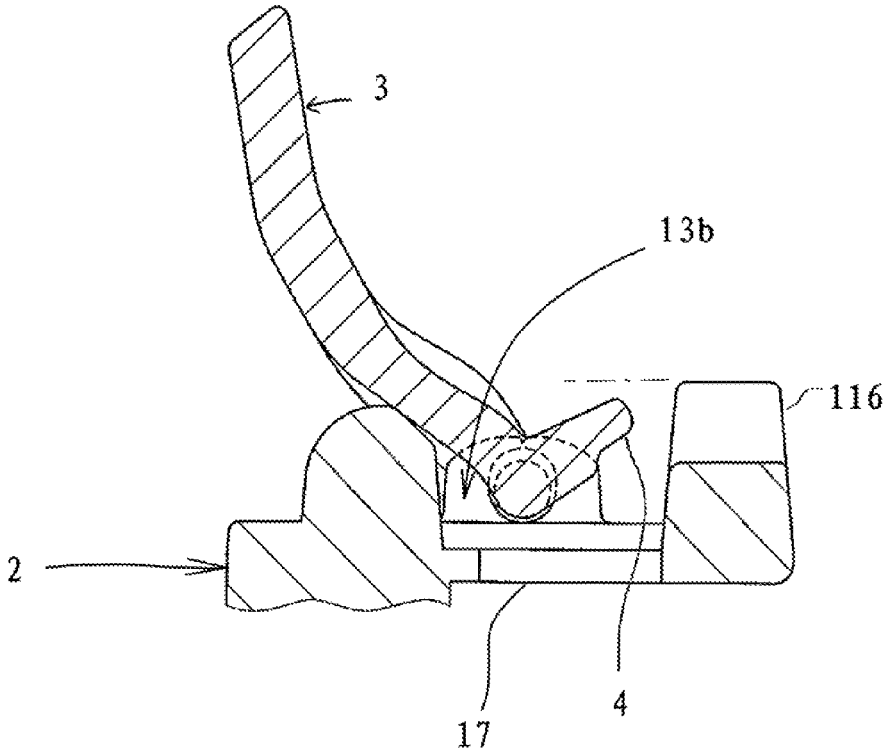
FIG. 17 is a sectional side view of the slider of the seventh embodiment of the present invention with the pull tab in the second posture.

FIGS. 16 and 17 are views of the slider of the seventh embodiment of the present invention. FIG. 16 is a sectional side view of the slider of the seventh embodiment of the present invention with the pull tab in the first posture. FIG. 17 is a sectional side view of the slider of the seventh embodiment of the present invention with the pull tab in the second posture. In the description of the present embodiment, the same or corresponding part to the fifth embodiment is assigned with a same reference sign, and the description thereof is omitted.

As shown in FIGS. 16 and 17, compared to the first embodiment, in the present seventh embodiment, the second column 116 is not provided with a second groove.

As shown in FIG. 17, when the pull tab 3 is in the second posture, the claw 4 is released from the elements path 14 and the hole 17, and between the pair (left and right) supporting parts 13*a*, 13*b* and the second column 116 it moves to between the plane where the top face of the second column 116 is located and the upper surface of the slider body 2. Herein, the front end of the claw 4 is located at the position (in the up-down direction) lower than the top face of the column 116. That is, between the pair (left and right) supporting parts 13*a*, 13*b* and the second column 116, the space formed between the plane where the top face of the second column 116 is located and the upper surface of the slider body 2 functions as the protection space.

Eighth Embodiment

Figure 18:
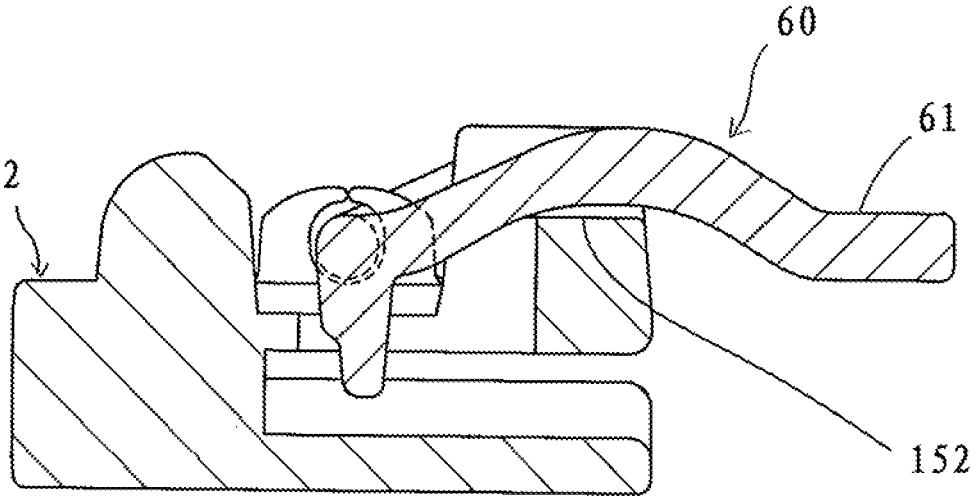
FIG. 18 is a sectional side view of the slider of the eighth embodiment of the present invention with the pull tab in the first posture.

FIG. 18 is a sectional side view of the slider of the eighth embodiment of the present invention with the pull tab in the first posture. In the description of the present embodiment, the same or corresponding part to the first embodiment is assigned with a same reference sign, and the description thereof is omitted.

As shown in FIG. 18, compared to the first embodiment, in the present eighth embodiment, the pull tab 60 is in a bending shape, thus when the pull tab 60 is in the first posture, the base 61 of the pull tab (the front end of the pull tab) is at the position lower than the portion of the pull tab 60 accommodated in the first groove 152 (that is, the position closer to the upper surface of the slider body 2). By means of making the pull tab 60 in such shape, when the pull tab 60 is in the first posture, it can avoid the pull tab 60 from hooking other objects.

Ninth Embodiment

Figure 19:
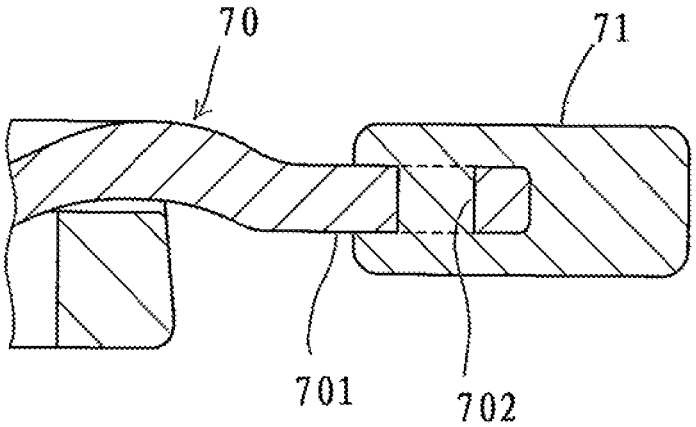
FIG. 19 is a partial sectional side view of the slider of the pull tab of the ninth embodiment of the present invention.

FIG. 19 is a partial sectional side view of the slider of the ninth embodiment of the present invention. In the description of the present embodiment, the same or corresponding part to the first embodiment is assigned with a same reference sign, and the description thereof is omitted.

As shown in FIG. 19, compared to the first embodiment, in the present ninth embodiment, the base 701 of the pull tab 70 (the front end of the pull tab) is mounted with a cover member 70 covering the base 701. The cover member 71, with the through hole 702 passing through the base in the up-down direction, covers the surface of the base 701. The cover member 71 can made of soft materials such as resin (for example, thermoplastic elastomer), rubber and so on.

Tenth Embodiment

Figure 20:
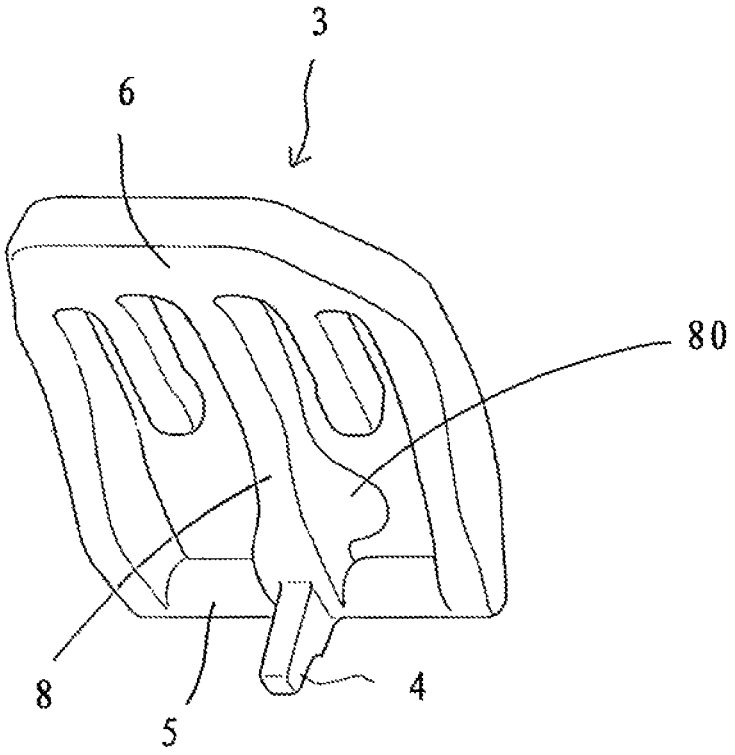
FIG. 20 is a perspective view of the slider of the pull tab of the tenth embodiment of the present invention.
Figure 21:
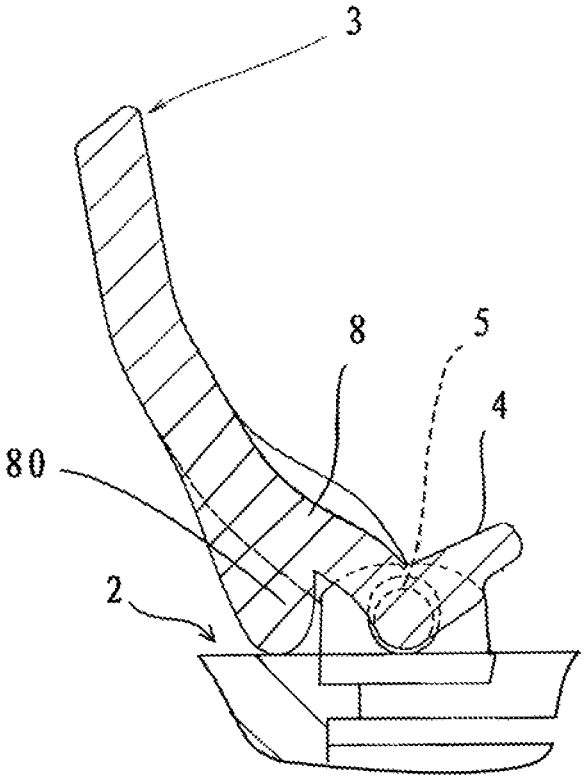
FIG. 21 is a partial sectional side view of the slider of the tenth embodiment of the present invention with the pull tab in the second posture.

FIGS. 20 and 21 are views of the slider of the tenth embodiment of the present invention. FIG. 20 is a perspective view of the slider of the pull tab of the tenth embodiment of the present invention. FIG. 21 is a partial sectional side view of the slider of the tenth embodiment of the present invention with the pull tab in the second posture. In addition, in the description of the present embodiment, the same or corresponding part to the first embodiment is assigned with a same reference sign, and the description thereof is omitted.

As shown in FIGS. 20 and 21, compared to the first embodiment, in the present tenth embodiment, the slider body is not provided thereon with a first column as the stop member, but an abutting portion 80 protruding from the upper surface of the pull tab 3 is formed on the upper surface of the pull tab 3 (particularly, the rod 8), that is, the surface opposite to the side on which the claw 4 is formed. The abutting portion 80 plays the same function as what the first column plays in the first embodiment.

As shown in FIG. 21, when the pull tab 3 is in the second posture, the abutting portion 80 abuts the upper surface of the slider body 2, so as to use the abutting portion 80 to limit the pull tab 3 in the erect position of the second posture, preventing the pull tab 3 from further inclining in the opposite direction (the front direction).

Other Embodiments

In each embodiments mentioned above, as for the stop member, although the situation that the first column is provided on the upper surface of the slider body and the situation that the abutting portion is provided on the surface of the side of the pull tab opposite to the side where the claw is formed are illustrated, it is possible to provide the first column and the abutting portion simultaneously. When the pull tab is in the second posture, the pull tab is limited to the erect position of the second posture by the abutment between the abutting portion provided at the pull tab and the first column provided at the slider body, so as to prevent the pull tab from further inclining to the opposite direction (the front direction) and ensure the front end of the claw to be accommodated in the protection space.

In addition, in the above embodiments, such as the first embodiment, although it is illustrated that the first groove is formed along the fore-and-aft direction of the second column, at the center in the left-right direction of the top of the second column, it is also possible that the first groove is provided on the top of the second column along other directions according to the direction in which the rod is arranged. For example, in the case that the rod is arranged in the left-right direction of the pull tab, it is also possible that the first groove is provided along the left-right direction of the second column.

The present invention also provides a slide fastener which comprises the slider for the slide fastener according to the above individual embodiments.

In summary, the present invention is described with embodiments, however the present invention is not limited to the above embodiments. Without departing from the principle of the present invention, various modifications and combinations can be made. The present invention includes all the alternative and application examples covered in the scope of the present invention defined by the claims.

The invention claimed is:

1. A slider for slide fastener, comprising a slider body and a pull tab, wherein a pair of supporting parts rotatably supporting the pull tab are provided on an upper surface of the slider body, and a claw for engaging elements of the slide fastener is provided on the pull tab, wherein the pull tab is rotatable between a first posture in which the pull tab is placed down on the slider body so that the claw is engaged with the elements of the slide fastener in an elements path of the slider and a second posture in which the pull tab is erected from the slider body so that the claw is released from the elements path of the slider, wherein a stop member is provided on at least one of the slider body and the pull tab, and wherein the stop member limits the pull tab in an erect position of the second posture such that a front end of the claw is located within a protection space.

2. The slider for slide fastener according to claim 1, wherein the stop member is a first column provided on the upper surface of the slider body and positioned at a front in a fore-and-aft direction of the slider body, and when the pull tab is in the second posture, the pull tab abuts the first column.

3. The slider for slide fastener according to claim 2, wherein the protection space is formed between the pair of the supporting parts.

4. The slider for slide fastener according to claim 2, wherein the first column is provided with an inclining face which inclines downward from a top surface of the first column toward to the supporting parts.

5. The slider for slide fastener according to claim 1, wherein a front end of the pull tab is mounted with a cover member covering the front end, and the cover member is made of a soft material.

6. The slider for slide fastener according to claim 5, wherein the soft material is resin or rubber.

7. A slide fastener comprising the slider for slide fastener according to claim 1.

8. A slider for slide fastener, comprising a slider body and a pull tab, wherein a pair of supporting parts rotatably supporting the pull tab are provided on an upper surface of the slider body, and a claw for engaging elements of the slide fastener is provided on the pull tab, wherein the pull tab is rotatable between a first posture in which the pull tab is placed down on the slider body and a second posture in which the pull tab is erected from the slider body, wherein a stop member is provided on at least one of the slider body and the pull tab, wherein the stop member limits the pull tab in an erect position of the second posture such that a front end of the claw is located within a protection space, wherein the stop member is a first column provided on the upper surface of the slider body and positioned at a front in a fore-and-aft direction of the slider body, and when the pull tab is in the second posture, the pull tab abuts the first column, wherein on the upper surface of the slider body, a second column is also formed at a position opposite to the first column across the pair of the supporting parts, wherein a hole communicating with an elements path is formed between the pair of the supporting parts in such a way that the hole passes through the upper surface of the slider body, a groove communicating with the hole is formed on the second column, wherein the pull tab is provided with a window, the window is provided therein with a pair of left and right snapping flakes extending from an edge on one side to an edge on the other side, wherein a head for being snapped with the pair of the snapping flakes is formed on the second column, and wherein the protection space is formed at the groove.

9. The slider for slide fastener according to claim 8, wherein opposite end edges arranged opposite to each other are formed respectively at front ends of the pair of snapping flakes, and a protruding end edge protruding to left and right sides is formed on the head, and wherein when the pull tab is in the first posture, the pair of snapping flakes are snapped with the head in such a way that the opposite end edges are located below the protruding end edges.

10. A slider for slide fastener, comprising a slider body and a pull tab, wherein a pair of supporting parts rotatably supporting the pull tab are provided on an upper surface of the slider body, and a claw for engaging elements of the slide fastener is provided on the pull tab, wherein the pull tab is rotatable between a first posture in which the pull tab is placed down on the slider body and a second posture in which the pull tab is erected from the slider body, wherein a stop member is provided on at least one of the slider body and the pull tab, wherein the stop member limits the pull tab in an erect position of the second posture such that a front end of the claw is located within a protection space, wherein the stop member is a first column provided on the upper surface of the slider body and positioned at a front in a fore-and-aft direction of the slider body, and when the pull tab is in the second posture, the pull tab abuts the first column, wherein on the upper surface of the slider body, a second column is also formed at a position opposite to the first column across the pair of the supporting parts, and wherein between the pair of the supporting parts and the second column, the protection space is formed between a plane where a top surface of the second column is located and the upper surface of the slider body.

11. The slider for slide fastener according to claim 10, wherein the pull tab has a window which is provided therein with a rod and the rod protrudes from an edge of one side of the window and is connected with an edge of opposite other side of the window, wherein a first groove is formed at a top of the second column, and wherein when the pull tab is in the first posture, at least one portion of the rod is accommodated in the first groove.

12. The slider for slide fastener according to claim 11, wherein the first groove extends along the fore-and-aft direction of the second column.

13. The slider for slide fastener according to claim 12, wherein between the pair of the supporting parts, a hole communicating with an elements path is formed in such a way that the hole passes through the upper surface of the slider body, and a second groove communicating with the hole is formed on one side of the second column facing to the pair of the supporting parts, and wherein the protection space is formed at the second groove.

14. The slider for slide fastener according to claim 13, wherein in the window, a pair of left and right snapping flakes extending from an edge of one side to an edge of other side, are formed in a way of being separated by the rod, and wherein a head snapped with the pair of snapping flakes is formed on the second column.

15. The slider for slide fastener according to claim 11, wherein the pull tab is in a bending shape such that when the pull tab is in the first posture, a front end of the pull tab is located lower than a portion thereof accommodated in the first groove.

16. The slider for slide fastener according to claim 13, wherein the first groove is communicating with the second groove.

* * * * *